US006326930B1

(12) United States Patent
Jones

(10) Patent No.: US 6,326,930 B1
(45) **Date of Patent: *Dec. 4, 2001**

(54) APPARATUS FOR REMOTE MONITORING AND CONTROL OF AN AUTOMATIC DEICING CONTROLLER

(75) Inventor: Thaddeus M. Jones, Bremen, IN (US)

(73) Assignee: MSX, Inc., South Bend, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/645,636

(22) Filed: Aug. 24, 2000

(51) Int. Cl.[7] ..... H01Q 1/02
(52) U.S. Cl. ..... 343/704; 343/840; 392/422
(58) Field of Search ..... 343/704, 840; 37/199; 392/422, 420; 219/213

(56) References Cited

U.S. PATENT DOCUMENTS 5,729,238 * 3/1998 Walton, Jr. ..... 343/704
5,861,855 * 1/1999 Arsenault et al. ..... 343/704
6,084,550 * 7/2000 Jones ..... 343/704
6,104,351 * 8/2000 Jones ..... 343/704
6,104,352 * 8/2000 Jones ..... 343/704
6,137,446 * 10/2000 Jones ..... 343/704
6,172,647 * 1/2001 Jones ..... 343/704

* cited by examiner

*Primary Examiner*—Tan Ho
(74) *Attorney, Agent, or Firm*—Taylor & Aust, P.C.

(57) ABSTRACT

A heated antenna system includes an antenna having a reflecting surface and a heater associated with the reflecting surface. A heater controller includes a temperature sensor and/or a moisture sensor. The heater controller applies a voltage to the heater dependent upon an output of the temperature sensor and/or moisture sensor. A monitoring unit overrides the heater controller upon an occurrence of at least one predetermined condition.

28 Claims, 4 Drawing Sheets

APPARATUS FOR REMOTE MONITORING AND CONTROL OF AN AUTOMATIC DEICING CONTROLLER

BACKGROUND OF THE INVENTION

1. Field of the Invention

The present invention relates to reflectors in satellite systems, and, more particularly, heating systems for reflectors in satellite systems.

2. Description of the Related Art

An antenna reflector, commonly called a dish, is generally a parabolic section having a round, elliptical or other configuration. A reflector functions to gather radio or microwave frequency energy transmitted from the feed horn or through the ambient environment from an external transmitter. The reflector can thus be used to receive and transmit signals to and from the satellite system. Typical applications include communicating data collected by a point of sale terminal in a store to the central data processing location. In this way, a large company can keep track of its sales and inventory requirements on an instantaneous basis. Maintaining a reliable satellite contact is absolutely essential. Reflectors are usually located outdoors, where snow and ice may collect on the receiving or concave side, degrading the performance of the reflector. If the link fails, store clerks have no way of executing any transactions with a customer. Thus, outages caused by snow and ice accumulation on the antenna reflector and feed are intolerable. In view of this, it is known to install heating apparatuses for deicing antennas in climates where snow and ice can present problems.

An antenna for the satellite terminal is often installed on the roof of the structure. Power line voltage is wired to the antenna for deicing purposes. Such power line voltage must be carried in a conduit on the outside of the building, or fed through an opening in the roof. A deicing controller or heater controller can be used to interconnect the power line with the heating apparatus. The heater controller ensures that power is applied to the heater only when it is needed, such as in the presence of precipitation while the ambient temperature is near or below freezing. If the heater controller malfunctions, however, the heater may not operate, snow and ice may collect on the reflector, and the performance of the reflector can be degraded. If the heater controller malfunctions such that power is applied to the heater continuously, electrical power is wasted and damage may result to the reflector and/or heater due to overheating. A primary cause of failure of a heater controller is a relay becoming stuck or frozen in either a closed position or an open position.

What is needed in the art is a heater controller that can be remotely monitored to ensure that trouble-free operation is maintained.

SUMMARY OF THE INVENTION

The present invention provides a monitoring unit that can be installed on a heater controller in order to remotely monitor operation of the heater controller and remotely control operation of the heater.

The invention comprises, in one form thereof, a heated antenna system including an antenna having a reflecting surface and a heater associated with the reflecting surface. A heater controller includes a temperature sensor and/or a moisture sensor. The heater controller applies a voltage to the heater dependent upon an output of the temperature sensor and/or moisture sensor. A monitoring unit overrides the heater controller upon an occurrence of at least one predetermined condition.

An advantage of the present invention is that a malfunctioning heater controller can be overridden to thereby continue heater operation.

Another advantage is that a heater controller can be monitored from a remote location, thereby enabling a single person to monitor thousands of heater controllers.

Yet another advantage is that the monitoring unit can be easily installed onto an existing heater controller without any specialized tools.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
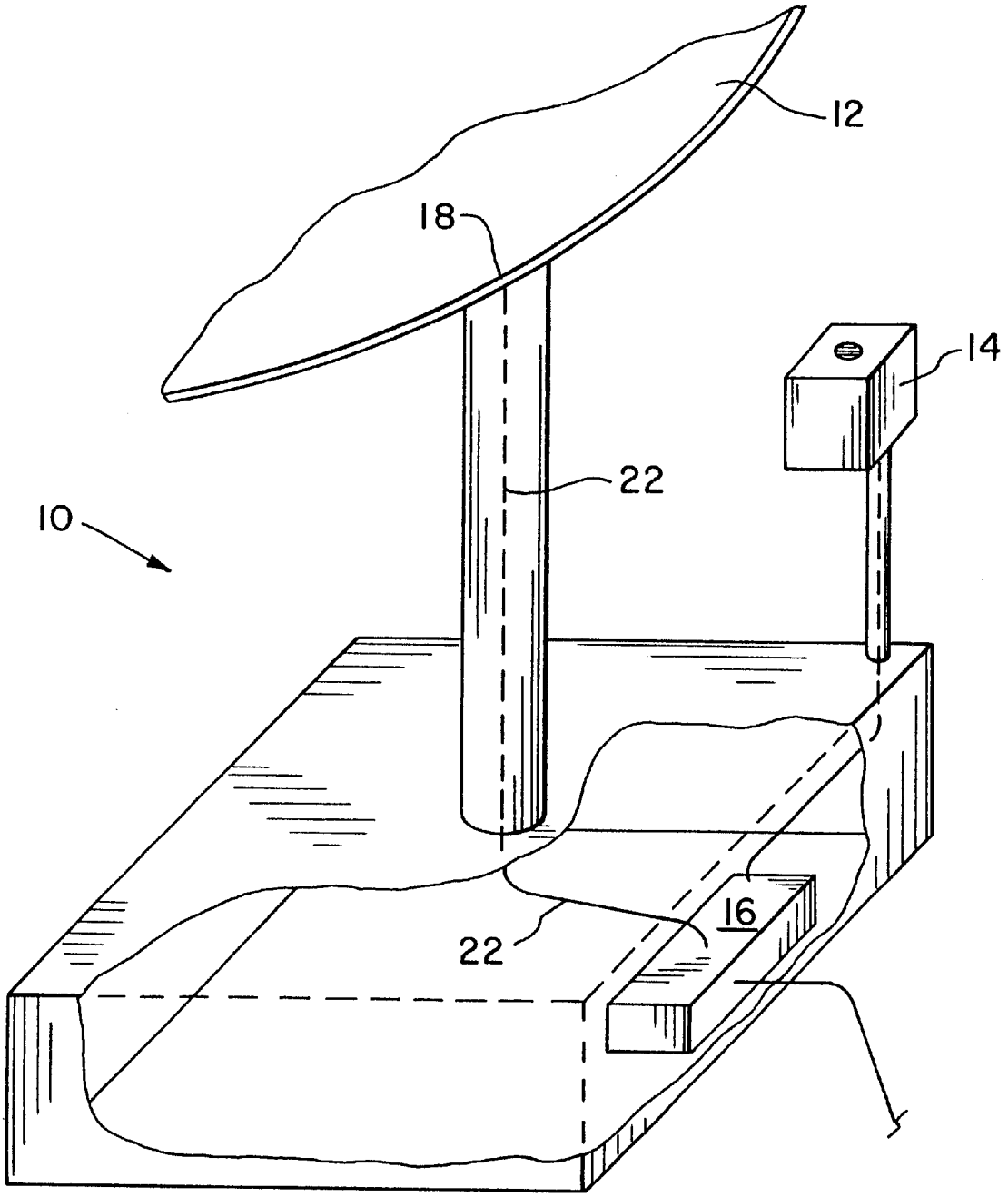
FIG. 1 is a perspective view of one embodiment of a heated antenna system of the present invention.

Referring now to the drawings and particularly to FIG. 1, there is shown one embodiment of a heated antenna system 10 of the present invention. System 10 includes an antenna 12, a heater controller 14 and a monitoring unit 16.

Antenna 12 includes a reflecting surface 18 having an electrical resistance heater 20 (FIG. 2) embedded therein. A cable 22 carries power to heater 20 as well as data and signals to be transmitted or received by antenna 12.

Heater controller 14 operates the deicing heater 20 during snow conditions and for an hour thereafter. Holding heater 20 on for an hour after snow conditions cease clears any accumulated snow or ice. Thus, heater controller 14 minimizes energy costs without reducing the reliability of antenna 12.

Figure 2:
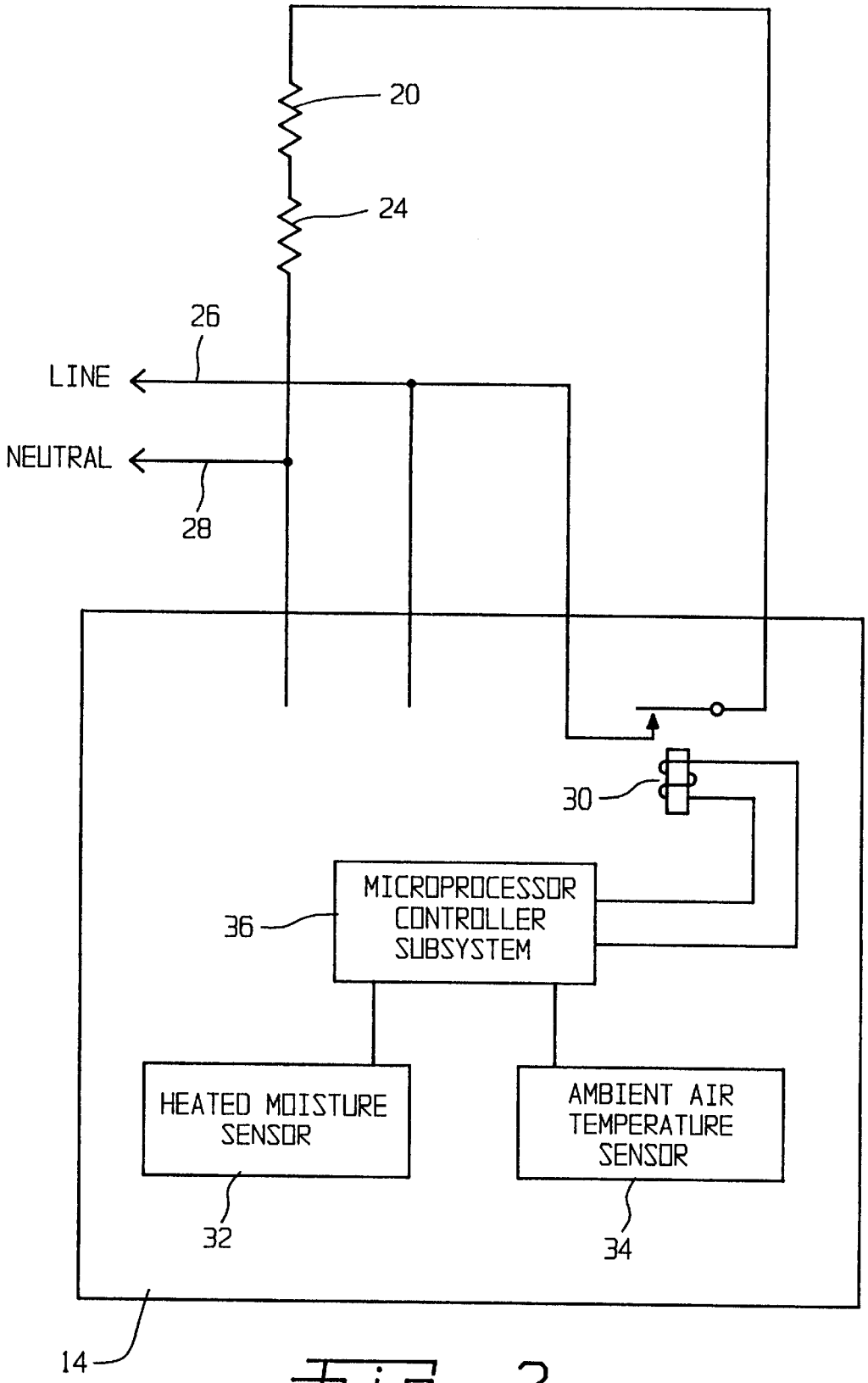
FIG. 2 is a schematic diagram of a heater controller directly connected to a heater.

Heater controller 14 is shown in FIG. 2 as controlling both reflector heater 20 and a feed heater 24 for heating a feedhorn (not shown). Depending upon the heating system design, heaters 20 and 24 can be connected in series or in parallel. A power line includes a line side 26 and a neutral side 28 which supply power to heaters 20, 24 and heater controller 14. A normally open relay 30 located within heater controller 14 enables the flow of heater current during snow conditions. That is, during snow conditions and for an hour thereafter. The presence of snow conditions is sensed by a moisture sensor 32 and a temperature sensor 34. The outputs of sensors 32, 34 are fed to a microcontroller 36 which controls relay 30.

Monitoring unit 16 uses the satellite link provided by antenna 12 to transmit, monitor and control data to and from a central location where operating personnel are located.

This permits one or two people to supervise and control an entire communications network employing thousands of heated antenna systems 10.

Figure 3A:
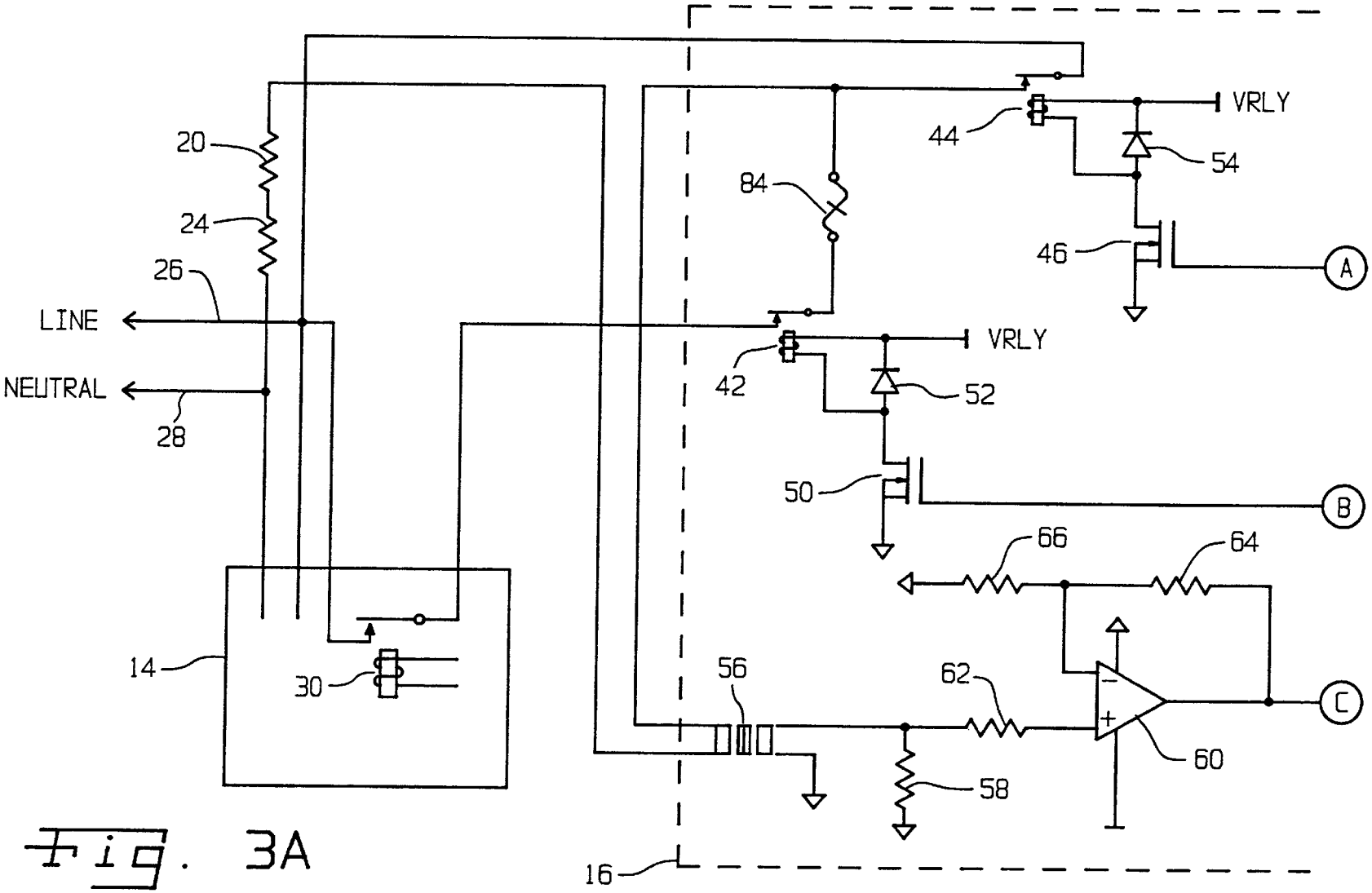
FIG. 3A is a partial schematic diagram of the heater, heater controller and monitoring unit of FIG. 1.
Figure 3B:
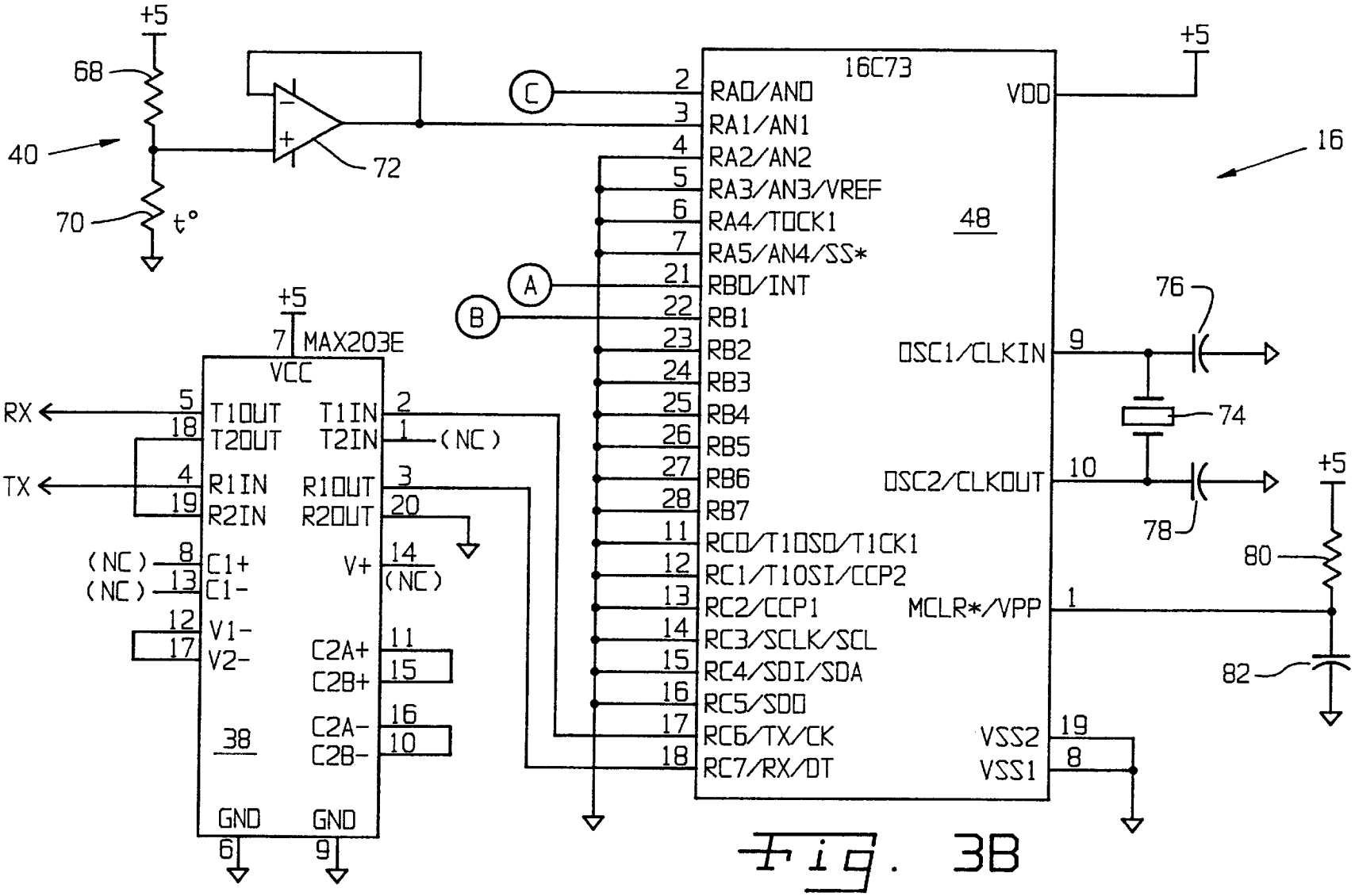
FIG. 3B is a partial schematic diagram of the monitoring unit of FIG. 1.

Monitoring unit 16 operates with a simple asynchronous serial protocol using a RS-232C electrical interface 38 (FIG. 3B). The commands and responses transmitted over interface 38 employ simple ASCII messages in abbreviated plain English for simplicity. This choice makes it practical to use a palm or knee-top computer with commonly available low-cost terminal emulation software to verify the proper installation of monitoring unit 16 at the antenna site. Interface 38 includes a line RX for receiving commands and a line TX for transmitting responses. Each of lines RX and TX are connected to antenna 12 through cable 22.

Monitoring unit 16 monitors the operation of heater controller 14. If monitoring unit 16 detects certain failures, it overrides heater controller 14 to insure continued deicing, albeit with greater energy use. Monitoring unit 16 also allows operating personnel to observe the operation of heater controller 14. Based upon this information, the operating personnel can take no action, override heater controller 14 to cause continued heater operation, override heater controller 14 to inhibit heater operation, or change the mode of heater controller 14. In addition, an auxiliary temperature sensor 40 provides operating personnel with the ambient temperature at the antenna site so that they can make better command decisions.

FIGS. 3A and 3B illustrate monitoring unit 16 having been installed onto heater controller 14 of FIG. 2. The modifications to the FIG. 2 wiring permit monitoring unit 16 to override the control of heaters 20, 24 exercised by heater controller 14.

Monitoring unit 16 monitors snow melting system operation inferentially. More particularly, monitoring unit 16 checks the continuity of the heater circuit by measuring heater circuit current while heater controller 14 is bypassed. Monitoring unit 16 also measures temperature at the antenna site via auxiliary temperature sensor 40.

Heater operation at temperatures above 4.4° C., or continuous heater operation for more than a predetermined time period, indicates failure of heater controller 14, possibly due to relay 30 being stuck or frozen in a closed position. The predetermined time period 30 can be arbitrarily set, such as at 100 hours. In the event that monitoring unit 16 detects either of these problems, it overrides the operation of heater controller 14 by operating heaters 20, 24 thermostatically. That is, heaters 20, 24 are on at ambient temperatures below 3.3° C. and are off at ambient temperatures above 4.4° C. This provides thermostatic control at the antenna site until service personnel can correct the problem at a time of their convenience. During this time interval, deicing is assured, albeit at the expense of increased energy use. Thus, monitoring unit 16 provides 'work while crippled' capability.

Remote personnel can issue commands that, independent of heater controller 14, cause continuous deicing heater operation, inhibit heater operation, or perform thermostatic heater control based upon ambient temperature. Monitoring unit 16 sends the ambient temperature at the antenna site to operating personnel. Although, for reasons of economy, monitoring unit 16 does not detect snow, operational personnel can still detect a deicing system failure. If the ambient temperature at an antenna site is below 3.3° C. and an increasing data error rate is observed, a deicing system failure could be the problem. In this case, operating personnel could either bypass heater controller 14 and cause continuous heater operation or command thermostatic control to insure continued antenna reliability.

As an additional safety measure, monitoring unit 16 requires interrogation by operating personnel periodically. If no interrogation is received within an hour, an arbitrary time interval, monitoring unit 16 assumes that heater controller 14 is not operational and that snow has caused a loss of communications, resulting in the need for thermostatic heater control.

De-energizing a relay 42 prevents heater controller 14 from controlling heaters 20, 24. With relay 42 de-energized, relay 44 controls heaters 20, 24. Energizing relay 44 turns on heaters 20, 24 and de-energizing relay 44 turns off heaters 20, 24. When heater controller 14 controls heaters 20, 24, relay 42 must be energized and relay 44 must be de-energized.

Relay 44 is energized by causing an enhancement mode n-channel metal oxide field effect transistor (MOSFET) 46 to conduct. MOSFET 46 conducts when a logical '1' is written to pin 21 of a microcontroller 48. Similarly, relay 42 is energized by causing a MOSFET 50 to conduct. MOSFET 50 conducts when a logical '1' is written to the pin 22 of microcontroller 48. Diodes 52 and 54 prevent destructive voltage transients from occurring when their respective relays are de-energized.

Microcontroller 48 is a PIC16C73 unit manufactured by Microchip Technology, Inc. of Chandler, Ariz. Its capabilities include one-time programmability, an asynchronous serial transceiver (i.e., a UART), a 5-channel a–d converter, an on-board crystal controlled clock generator, 4 K words of program memory, 192 bytes of data memory, timers, twenty-two I/O pins and a built-in fail-safe timer. It employs CMOS technology for low power consumption, wide operating voltage range and high speed.

Current transformer 56 senses current in heaters 20, 24. Resistor 58 is a current shunt. Since current transformer 56 has a single turn primary winding, the current flowing through resistor 58 is inversely proportion to the number of secondary turns. The voltage at the secondary of current transformer 56 approximately equals the line current times the value of resistor 58 divided by the number of secondary turns.

An operational amplifier 60 operates from a single polarity DC power supply voltage. The voltage across resistor 58 is bi-polar. A resistor 62 along with the substrate diode between operational amplifier 60 and ground clamps the negative voltage excursions to a safe value.

Current transformer 56 is a low power device, and thus produces a small secondary signal. This signal requires amplification by operational amplifier 60 before application to microcontroller 48 a–d converter input. The non-inverting gain of operational amplifier 60 is equal to one plus the value of resistor 64 divided by the value of resistor 66.

The waveform inputted from operational amplifier 60 to the a–d converter in microcontroller 48 is the positive half-wave portion of a sine wave. Microcontroller 48 calculates a number proportional to the root mean square value of the heater current from the a–d converter sample values.

Auxiliary temperature sensor 40 is in the form of a temperature sensitive voltage divider including a resistor 68 and a thermistor 70 which senses ambient temperature. The output of the voltage divider is buffered by an operational amplifier 72 that is configured as a unity gain voltage follower. This is necessary to prevent loading errors caused by the relatively low input impedance of the a–d converter function provided by microcontroller 48.

A quartz crystal 74 determines the clock frequency for microcontroller 48. Capacitors 76 and 78 provide the phase shift and filtering required for rapid clock generator start-up and stable operation at the proper crystal frequency as opposed to spurious operation at one of the overtone frequencies (i.e., the $3^{rd}$, $5^{th}$, $7^{th}$, etc. harmonics of the fundamental crystal frequency). Resistor 80 and capacitor 82 provide a time delay to ensure that microcontroller 48 starts properly upon the application of DC power.

Interface integrated circuit 38 is a MAX203E 4-channel RS232C transceiver made by Maxim Semiconductor, Inc. of Sunnyvale, Calif. Only two channels of interface 38 are used in the present invention. RS232C is an EIA (Electronic Industries Association) electrical interface of bi-polar data transmission signals. The MAX203E internally generates the positive and negative power supply voltages required for implementing the RS-232C interface. The MAX203E converts transmitted data logic signals from microcontroller 48 into corresponding RS232C logic levels. The MAX203E also converts the RS-232C received logic signals into logic levels inputted to microcontroller 48.

Monitoring unit 16 receives commands specifying its operating mode from remotely located operating personnel. For simplicity, the commands are sent as strings of ASCII characters. The response from monitoring unit 16 is also in the form of strings of ASCII characters. The character strings are abbreviations for commands or responses.

Shown below is the list of commands available to remotely located operating personnel along with corresponding responses from monitoring unit 16.

STATUS—Monitoring unit 16 responds with the deicing system status

ON—Overrides heater controller 14 to cause continuous deicing heater operation OFF—Overrides heater controller 14 to inhibit heater operation TSTAT—Overrides heater controller 14 to cause thermostatic deicing control based upon the ambient temperature at the antenna site TEMP—Monitoring unit 16 responds with the ambient temperature at the antenna site RESET—Restores control of heaters 20, 24 to heater controller 14

In response to a STATUS command, monitoring unit 16 can issue one of the following responses: HEAT, IDLE, TSTAT or FAULT. If the response is FAULT, monitoring unit 16 can also provide the following responses to specify the type of fault:

OPEN—Open heater

STUCK—Heater controller relay contact stuck in its closed position

TIMEOUT—Heater controller relay stuck in its closed position

COMFAIL—Communications failed for more than one continuous hour. In this case, monitoring unit 16 reverts to the thermostatic control mode until communications is resumed. This assures reliable station operation in the event snow or ice in the antenna combined with a heater controller failure caused the loss of communications.

Monitoring unit 16 may also provide the following responses:

ON—Heaters 20, 24 operate continuously unless no heater current or an ambient temperature above 10° C. is observed at the antenna site. In first case, monitoring unit 16 responds with the FAULT dialogue. In the second case, heaters 20, 24 turn on for two minutes and then turn off for four minutes to prevent overheating.

OFF—Heater operation is inhibited

TSTAT—Thermostatic control mode is selected

TEMP=XXX—Ambient temperature at the antenna site in degrees C.

RESET—Control is transferred to heater controller 14 and the FAULT data is cleared Monitoring unit 16 can be an add-on device that is to be installed or retrofitted onto an existing heater controller 14. Thus, the mechanical configuration of monitoring unit 16 is important. During installation, the power cord and weatherproof fitting are removed. Monitoring unit 16 is attached to the conduit boss from which the power cord and weatherproof fitting were removed. The wires from monitoring unit 16 are routed into a junction box. Next, the power cord is passed through the open end of a 'T' fitting and then into the junction box. The power cord is secured by installing the weatherproof fitting into the 'T' fitting. The wires in the junction box are spliced and secured using wire nuts.

Installing monitoring unit 16 requires no special tools. Only a pair of pump pliers, wire cutters and a wire stripper are required. These are a standard part of the installation personnel's tool box.

The choice of a simple ASCII communications protocol further simplifies installation. The operation of monitoring unit 16 can be verified at the antenna site using either a palm or knee-top computer with commonly available terminal emulation software.

An integrated circuit manages the microcontroller 48 reset. The integrated circuit holds microcontroller 48 in its reset mode until the power supply voltage reaches its proper level after power application. The integrated circuit also includes a fail safe timer in the event microcontroller 48 latches due to extreme electromagnetic interference.

A high-limit electromechanical thermostat 84 provides over-temperature protection in the event that a failure occurs with relays 30, 42 and/or 44 stuck in a position that causes continuous heater operation with heater controller 14 bypassed. Continuous heater operation at high ambient temperatures could cause heater damage due to overheating. Thus, typically, thermostat 84 opens at 32° C. and closes at 26° C.

The use of an electromechanical thermostat rather than an electronic implementation is an important consideration. Reliability requires that thermostat 84 and the remainder of monitoring unit 16 have completely different failure mechanisms. The most economical approach to the problem is to provide an electronic over-temperature thermostat that shares the power supply and circuit board used for monitoring unit 16. This is not acceptable since sharing common components could result in the simultaneous failure of both monitoring unit 16 and over-temperature protection, thus creating a potentially unsafe condition.

Monitoring unit 16 communicates indirectly to operational personnel through its asynchronous serial communications port with RS232C electrical interface 38. It is also possible to use another type of electrical interface, such as a RS422 or a RS485.

Operating personnel are not located at the remote station site. Thus, monitoring unit 16 is usually connected to a station monitor and control system used for the local site. This provides an interface between remotely located operating personnel and important local subsystems, including the monitoring unit 16 used with the snow and ice melting system.

In the case of large hub earth stations (HES), operation personnel may be at the site with the antenna necessarily located outdoors. The HES communicates with many, often thousands, of remotely located stations. Thus, a hub monitor and control system often interfaces both the HES station facilities and thousands of remote sites.

The remote sites communicate with the hub monitor and control system located at the HES through a land line (e.g., usually a copper or fibre optic data line) or the satellite link. That is, the station monitor and control system shares the communications link with the customer's data. Sharing the satellite link creates a unique problem. Loss of the satellite link involuntarily terminates the ability to remotely monitor and control the site.

Heater controller 14 may fail during or before a heavy snow. Accumulating snow on antenna reflector 12 and its feed may cause an interruption of the satellite link. In this case, the remote monitor and control is lost and the defective heater controller 14 cannot be overridden by monitoring unit 16. This prevents operating personnel at the HES from taking corrective action.

The loss of the link can be prevented, or the down time minimized, by requiring the hub monitor and control system to poll monitoring unit 16 through the station monitor and control system at regular intervals, such as every 30 minutes or so. As a background task, monitoring unit 16 waits to be polled. If polling does not occur within five minutes of the normal interval, monitoring unit 16 assumes a loss of communications and reverts to thermostatic control. Thereafter, monitoring unit 16 continues waiting to be polled. When polling resumes, monitoring unit 16 restores the system state existing before the loss of communications. Thereafter, monitoring unit 16 resumes its background task of waiting to be polled.

Minimizing polling overhead requires minimal message content. Conversely, assessing problems and exercising remote control requires relatively long messages approaching plain English for self-documentation and simplicity. The software for parsing and decoding verbose messages is complex. Verbose messages increase the transmission and receiving times, thus making polling overhead objectionable.

The present invention solves this problem by dividing the transmitted and received messages into two separate modes: polling mode and maintenance mode. In the polling mode, the hub monitor and control system polls monitoring unit 16 through the station monitor and control system every half hour or so, using a single byte query. For example, an ASCII could be used as a query character.

Upon receiving a monitoring unit 16 makes one of three single byte responses depending upon its state and those of heater controller 14 and the heating system. The single byte ASCII character responses are, for example: '0' for normal operation, '1' for operating mode selected remotely, and '2' for a fault condition requiring attention of operating and/or maintenance personnel. The high level software for the hub monitor and control system is trivial.

The interface discussed previously constitutes the maintenance mode activities. The maintenance mode is entered by transmitting an ASCII '*' to monitoring unit 16. This can be done remotely from the HES or locally at the antenna site. Monitoring unit 16 responds with its model and serial numbers as ASCII strings. Independent of the place of origin, no special hardware or software is required. That is, all that is required as an interface is a minimal personal computer running a terminal emulator such as Kermit or Procomm. Thus, monitoring mode activities can be performed at the antenna site or the HES without the need for special hardware or software. Communications is done interactively by operating or service personnel.

Separating the polling mode and the maintenance mode affords an additional important advantage. The maintenance mode software resident in monitoring unit 16 is independent of the polling mode requirement. Thus, the maintenance mode/polling mode scheme permits different versions of monitoring unit 16 to be interfaced without the need for changing hub monitor and control system software. All that is needed for each maintenance mode interface is a simple printed sheet of operating instructions.

The present invention has been described herein as being used with a reflector antenna heater. However, it is to be understood that the present invention can also be used to remotely monitor and control any type of load that is operated with an electrical controller.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A heated antenna system, comprising:

an antenna having a reflecting surface and a heater associated with said reflecting surface;

a heater controller including at least one of a temperature sensor and a moisture sensor, said heater controller being configured for applying a voltage to said heater dependent upon an output of said at least one of a temperature sensor and a moisture sensor; and a monitoring unit configured for overriding said heater controller upon an occurrence of at least one predetermined condition.

2. The system of claim 1, wherein said monitoring unit is remotely controllable.

3. The system of claim 2, wherein said monitoring unit is coupled to said antenna, said monitoring unit being configured for at least one of receiving and transmitting at least one signal through said antenna.

4. The system of claim 3, further comprising an electrical interface interconnecting said monitoring unit and said antenna.

5. The system of claim 3, wherein said monitoring unit includes an auxiliary temperature sensor, said monitoring unit being configured for transmitting a temperature signal through said antenna, the temperature signal being dependent upon an output of said auxiliary temperature sensor.

6. The system of claim 1, wherein said heater controller includes a first switch in series with said heater, said monitoring unit including a second switch and a third switch, said second switch being in connected series with said first switch to form a series combination, said third switch being connected in parallel with said series combination of said first switch and said second switch.

7. The system of claim 6, further comprising a temperature sensitive switch connected in series with said first switch and with said second switch, said temperature sensitive switch being configured for opening upon rising to a first predetermined temperature and closing upon falling to a second predetermined temperature.

8. The system of claim 7, wherein said temperature sensitive switch comprises an electromechanical thermostat.

9. A method of operating a heated antenna system, said method comprising the steps of:

providing an antenna having a reflecting surface and a heater associated with said reflecting surface;

providing a heater controller including at least one of a temperature sensor and a moisture sensor;

automatically applying a voltage to said heater with said heater controller, said automatically applying step being dependent upon an output of said at least one of a temperature sensor and a moisture sensor;

monitoring operation of said heater controller with a monitoring unit; and overriding the operation of said heater controller dependent upon said monitoring step.

10. The method of claim 9, wherein said monitoring step is performed remotely.

11. The method of claim 10, comprising the further step of using said monitoring unit to at least one of receive and transmit at least one signal through said antenna.

12. The method of claim 9, wherein said overriding is performed if a failure of said heater controller is detected in said monitoring step.

13. The method of claim 9, wherein said monitoring step includes monitoring an electrical current flowing through said heater.

14. The method of claim 13, comprising the further step of measuring an ambient temperature with an auxiliary temperature sensor, said overriding being performed if the electrical current flows through said heater while the ambient temperature is above a predetermined temperature.

15. The method of claim 14, wherein said overriding step comprises operating said heater thermostatically using said monitoring unit.

16. The method of claim 15, wherein operating said heater thermostatically comprises:

applying the voltage to said heater if the ambient temperature is below a first predetermined temperature; and removing the voltage from said heater if the ambient temperature is above a second predetermined temperature.

17. The method of claim 13, wherein said overriding is performed if the electrical current flows through said heater continuously for a predetermined period of time.

18. The method of claim 9, wherein said overriding step includes one of applying the voltage to said heater and removing the voltage to said heater with said monitoring unit.

19. The method of claim 9, comprising the further step of receiving at least one remotely transmitted polling mode signal, said receiving step being performed using said monitoring unit.

20. The method of claim 19, wherein said overriding step is dependent upon said receiving step.

21. The method of claim 19, comprising the further step of removing the voltage from said heater if said at least one remotely transmitted polling mode signal is not received within a predetermined time period.

22. The method of claim 21, wherein said predetermined time period is between 30 minutes and 90 minutes.

23. The method of claim 9, comprising the further step of receiving at least one remotely transmitted maintenance mode signal, said receiving step being performed using said monitoring unit.

24. The method of claim 23, comprising the further step of using said monitoring unit to transmit at least one second maintenance mode signal to a remote location in response to the at least one remotely transmitted maintenance mode signal.

25. A method of modifying an antenna system including a heater and a heater controller, at least one electrical power line being connected to the heater controller, a control line interconnecting the heater controller and the heater, said method comprising the steps of:

cutting through the control line to thereby create two cut ends; and electrically connecting a monitoring unit to each of said cut ends of the control line.

26. The method of claim 25, comprising the further step of electrically connecting said monitoring unit to the at least one electrical power line, said monitoring unit thereby being configured for bypassing the heater controller to apply electrical power to the heater.

27. A heated antenna system, comprising:

an antenna having a reflecting surface and a heater associated with said reflecting surface;

at least one of a temperature sensor and a moisture sensor;

a heater controller configured for applying a voltage to said heater dependent upon an output of said at least one of a temperature sensor and a moisture sensor; and a monitoring unit configured for overriding said heater controller upon an occurrence of at least one predetermined condition.

28. The system of claim 27, wherein said at least one of a temperature sensor and a moisture sensor is one of separate from and integral with said heater controller.

* * * * *

UNITED STATES PATENT AND TRADEMARK OFFICE

CERTIFICATE OF CORRECTION

PATENT NO. : 6,326,930 B1
DATED : December 4, 2001
INVENTOR(S) : Thaddeus M. Jones It is certified that error appears in the above-identified patent and that said Letters Patent is hereby corrected as shown below:

Column 3,
Line 43, delete “30” therefor.

Column 7,
Line 42, delete “ASCII” and substitute -- ASCII‘?’ -- therefor; and
Line 44, delete “a monitoring” and substitute -- a ‘?’ monitoring -- therefor.

Signed and Sealed this

Fourth Day of March, 2003

JAMES E. ROGAN
*Director of the United States Patent and Trademark Office*